US008904918B2

(12) United States Patent
Lee et al.

(10) Patent No.: US 8,904,918 B2
(45) Date of Patent: Dec. 9, 2014

(54) HYBRID TYPE AIR-COMPRESSOR INCLUDING COMBINATION OF ECCENTRIC SHAFT AND CROSS-SLIDER MECHANISM

(75) Inventors: Tae Soo Lee, Gyeonggi-do (KR); Yoon Sun Choi, Seoul (KR); Seung Hwan Ryu, Namyangju-si (KR); Gil Jun Lee, Anyang-si (KR); Yong Duck Kim, Guri-Si (KR)

(73) Assignees: Oxus Co. Ltd. (KR); Industry-University Cooperation Foundation Sogang University (KR)

( * ) Notice: Subject to any disclaimer, the term of this patent is extended or adjusted under 35 U.S.C. 154(b) by 945 days.

(21) Appl. No.: 13/044,460

(22) Filed: Mar. 9, 2011

(65) Prior Publication Data

US 2012/0180652 A1 Jul. 19, 2012

(30) Foreign Application Priority Data

Jan. 18, 2011 (KR) ..... 10-2011-0005088

(51) Int. Cl.

| | |
|---|---|
| ***F01B 7/04*** | (2006.01) |
| ***F01B 9/02*** | (2006.01) |
| ***F04B 53/10*** | (2006.01) |
| ***F04B 39/00*** | (2006.01) |

(52) U.S. Cl.

CPC ..... *F01B 9/023* (2013.01); *F04B 39/0094* (2013.01); *F04B 349/14* (2013.01); *F04B 39/0005* (2013.01); *F04B 39/0016* (2013.01)

USPC ..... 92/72; 92/150; 92/164; 417/534

(58) Field of Classification Search

USPC ..... 92/72, 138, 150, 151, 164; 91/491, 493; 417/415, 534

See application file for complete search history.

(56) References Cited

U.S. PATENT DOCUMENTS

| | | | | | |
|---|---|---|---|---|---|
| 669,290 | A | * | 3/1901 | Stoer | 92/138 |
| 1,965,198 | A | * | 7/1934 | MacCabee | 92/72 |
| 4,072,210 | A | * | 2/1978 | Chien | 417/534 |
| 4,400,144 | A | * | 8/1983 | Drutchas et al. | 417/534 |
| 4,486,157 | A | * | 12/1984 | Hayashi | 92/138 |
| 6,234,774 | B1 | * | 5/2001 | Siviero | 417/534 |
| 7,938,632 | B2 | | 5/2011 | Smith | |
| 2007/0169619 | A1 | | 7/2007 | Smith | |

FOREIGN PATENT DOCUMENTS

| | | |
|---|---|---|
| JP | 05066276 | 9/1993 |
| JP | 2002-098045 | 4/2002 |
| KR | 10-2006-0094926 | 8/2006 |
| KR | 102006-0114706 | 11/2006 |
| KR | 9-5-2012-067756909 | 11/2012 |

* cited by examiner

*Primary Examiner* — Michael Leslie
(74) *Attorney, Agent, or Firm* — Wells St. John P.S.

(57) ABSTRACT

Disclosed is a hybrid type air-compressor, which has a main body including a cylinder having upper and lower portions, a motor assembly including an eccentric shaft passing through a side surface of the main body to eccentrically rotate in the cylinder, a first communication part covering an upper portion of the cylinder of the main body and introducing air to discharge the air to the upper portion of the cylinder, a second communication part covering a lower portion of the cylinder of the main body and introducing air to discharge the air to the lower portion of the cylinder; and an air compressing means connected to the eccentric shaft of the motor assembly and vertically moving in the cylinder to alternately compress air introduced into the upper and lower portions of the cylinder.

20 Claims, 6 Drawing Sheets

HYBRID TYPE AIR-COMPRESSOR INCLUDING COMBINATION OF ECCENTRIC SHAFT AND CROSS-SLIDER MECHANISM

CROSS-REFERENCE TO RELATED APPLICATION

Korean Patent Application No. 10-2011-0005088 filed on Jan. 18, 2011, with the Korean Intellectual Property Office and entitled "hybrid type air-compressor including a combination of an eccentric shaft and a cross-slider mechanism" is incorporated by reference herein in its entirety.

BACKGROUND

1. Field

Embodiments relate to a hybrid type air-compressor including a combination of an eccentric shaft and a cross-slider mechanism, in which the inner space of a cylinder is divided into two parts to compress introduced air in the two parts.

2. Description of the Related Art

In general, an air compressor includes a cylinder, a piston corresponding to the cylinder, and a crank mechanism.

The piston of the air compressor is not provided with a pin for connecting a crank rod thereto, unlike a piston used in an internal combustion engine.

Thus, in an air compressor using a crank mechanism, a piston is moved upward and downward along all the inclined path except for an upper dead point and a lower dead point, which causes the following limitations.

First, an inclination angle of a piston decreases air compressing efficiency. Because of a limitation in angle size, the length of a crank rod should be greater than a predetermined value, and thus, it is difficult to miniaturize a product.

Secondly, a cup made from polytetrafluoroethylene (TEFLON®) provided to a piston for preventing an air leakage along an inner surface of a cylinder is compressed in a predetermined direction, which reduces the service life of the cup.

Thirdly, since one piston is connected to one crack mechanism, the number of crack mechanisms should be increased according to the number of cylinders. Thus, the number of parts increases in proportion to the number of cylinders.

SUMMARY

An aspect of the present invention provides a hybrid type air-compressor including a combination of an eccentric shaft and a cross-slider mechanism, in which a piston can be moved vertically in a cylinder to improve durability of parts and simplify structures thereof.

According to one embodiment of the present invention, the hybrid type air-compressor may comprise a main body including a cylinder having opened upper and lower portions; a motor assembly including an eccentric shaft passing through a side surface of the main body and rotated eccentrically in the cylinder; a first communication part covering an upper portion of the cylinder of the main body for introducing air and discharging air to the upper portion of the cylinder; a second communication part covering a lower portion of the cylinder of the main body for introducing air and discharging air to the lower portion of the cylinder; and an air compressing means connected to the eccentric shaft of the motor assembly and moved vertically in the cylinder to alternately compress air introduced into the upper and lower portions of the cylinder.

The cylinder of the main body may be provided with a pair of guides provided fixedly thereon, the guides include vertical recesses corresponding to each other in the cylinder.

The main body may comprise an air introduction hole vertically passing through a side portion of the cylinder for bypassing and introducing some of air introduced into the first communication part into the lower portion of the cylinder; and an air discharge hole vertically passing through the other side portion of the cylinder for discharging air compressed in the lower portion of the cylinder.

The first communication part may comprises an upper cover covering the upper portion of the cylinder, and including an air introduction hole and an air discharge hole formed on both sides thereof and communicated with the cylinder; and an upper check plate provided between the upper cover and an upper end of the main body and configured to be opened and closed by air pressure.

The upper check plate may comprise a first slot recess formed on an upper surface of the upper check plate; a first introduction hole passing through the first slot recess for guiding some of air introduced through the air introduction hole to the upper portion of the cylinder; and a second introduction hole communicated with the air introduction hole for guiding remain of air introduced through the air introduction hole to the lower portion of the cylinder.

It is preferable that the upper check plate comprises a second slot recess formed on an upper surface of the upper check plate; a first discharge hole passing through the second slot recess for guiding air compressed in the upper portion of the cylinder to the air discharge hole; and a second discharge hole communicated with the air discharge hole is communicated with the air discharge hole for guiding air compressed in the lower portion of the cylinder to the air discharge hole.

In addition, the first communication part may further comprise a first check valve provided under the upper check plate to open and close the first introduction hole according to a predetermined air pressure or greater.

Also, the first communication part may further comprise a second check valve provided above the upper check plate to open and close the first discharge hole according to compressed air.

The second communication part may comprise a lower cover covering the lower portion of the cylinder, the lower cover including a first air receiving recess and a second air receiving recess formed on one side surface thereof, the first air receiving recess being communicated with the air introduction hole, the second air receiving recess being communicated with the air discharge hole; and a lower check plate provided between the lower cover and a lower end of the main body and configured to be opened and closed by air pressure.

The lower check plate may comprise a first slot recess formed on a lower surface of the lower check plate and communicated with the first air receiving recess; a first introduction hole passing through the first slot recess for allowing the air introduction hole to be communicated with the first air receiving recess; and a second introduction hole passing through the first slot recess for guiding air introduced through the first introduction hole to the lower portion of the cylinder.

In addition, the lower check plate may comprise a second slot recess formed on a lower surface thereof and communicated with the second air receiving recess; a first discharge hole passing through the second slot recess for guiding air compressed in the lower portion of the cylinder to the second air receiving recess; and a second discharge hole passing through the second slot recess for allowing the second air receiving recess to be communicated with the air discharge hole.

Also, the second communication part further comprises a first check valve provided above the lower check plate to open and close the second introduction hole according to air bypassed to the air introduction hole.

The second communication part may further comprise a second check valve provided under the lower check plate to open and close the first discharge hole according to compressed air.

The air compressing means comprises a bearing fixed to an outer circumference surface of the eccentric shaft; a bearing cover fixed to an outer circumference surface of the bearing; a cross slider including an ellipse part having an inner surface corresponding to the outer circumference surface of the bearing cover, and guiding protrusions formed on both sides on an outer surface thereof and corresponding respectively to the vertical grooves of the guides; and upper and lower piston assemblies linked to upper and lower portions of the cross slider, respectively, and being moved vertically in the upper and lower portions of the cylinder, respectively.

Each of the upper and lower piston assemblies may comprises a piston coupled to the upper or lower portion of the cross slider and moved vertically in the upper or lower portion of the cylinder; a cup made from polytetrafluoroethylene (TEFLON®) installed on an end of the piston, and a cup fixing cover fixed to upper or lower portion of the cup.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain principles of the present disclosure. In the drawings.

DETAILED DESCRIPTION

Hereinafter, embodiments will be described in detail with reference to the accompanying drawings.

In the following description, the technical terms are used only for explain specific exemplary embodiments while not limiting the present disclosure. The embodiments should be considered in descriptive sense only and not for purposes of limitation.

Figure 1:
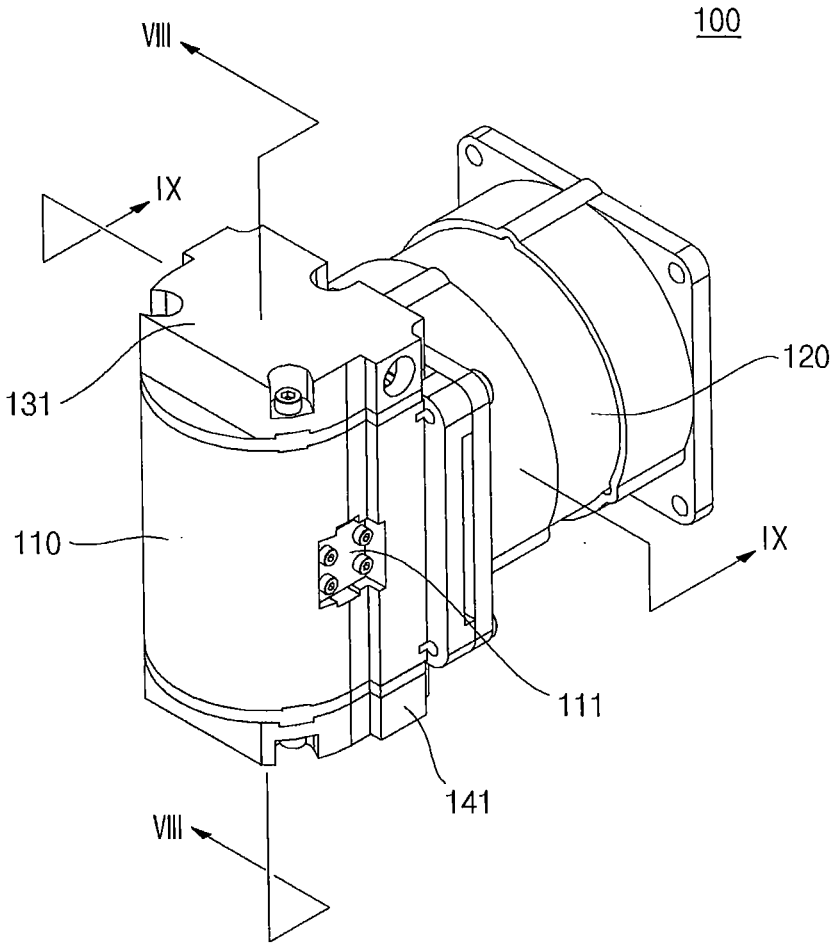
FIG. 1 is a perspective view illustrating a hybrid type air-compressor including a combination of an eccentric shaft and a cross-slider mechanism according to an embodiment.
Figure 2:
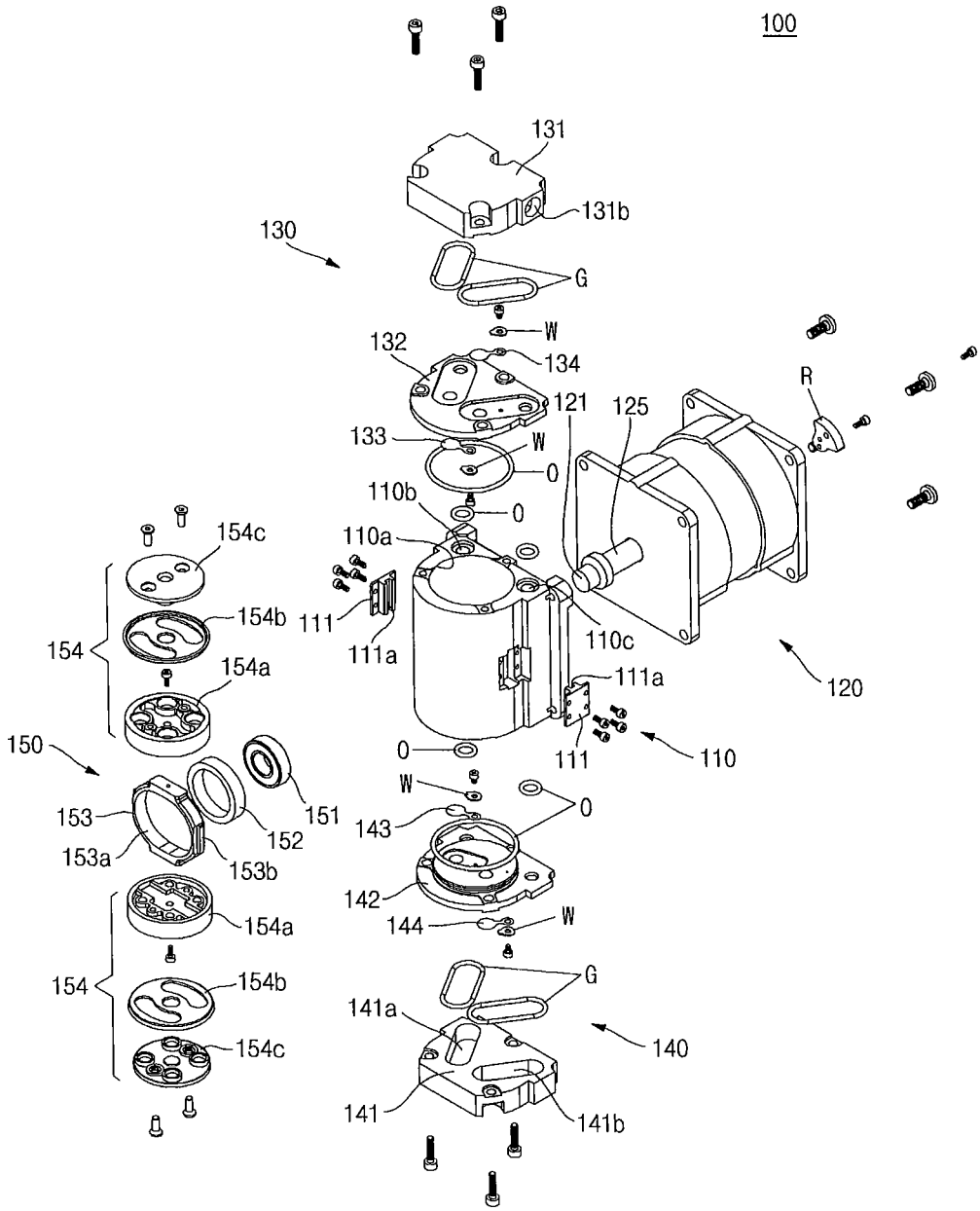
FIG. 2 is an perspective view illustrating the hybrid type air-compressor shown in FIG. 1.

Referring to FIGS. 1 and 2, a hybrid type air-compressor 100 according to an embodiment comprises a main body 110, a motor assembly 120, a first communication part 130, a second communication part 140, and an air compressing means 150.

The main body 110 includes a cylinder 110*a* having opened upper and lower ends, and a pair of guides 111 provided on the cylinder 110*a* and corresponding to each other. Each of the guides 111 includes a vertical groove 111*a* corresponding to that of the other guide.

Inner portions of the guides 111 are inserted into side portions of the main body 110 and are disposed in the cylinder 110*a*, and outer portions of the guides 111 are securely fixed to the main body 110 by fixing means (for example, bolts).

The main body 110 includes an air introduction hole 110*b* vertically passing through a side portion of the cylinder 110*a* and configured such that air introduced into the first communication part 130 is by-passed and then introduced into a lower portion 110*a*-2 of the cylinder 110*a*, and an air discharge hole 110*c* vertically passing through the other side portion of the cylinder 110*a* for discharging air compressed in the lower portion 110*a*-2 of the cylinder 110*a*.

The upper and lower ends of the main body 110 are provided with bolt holes (not indicated by reference numeral) for coupling integrally the first communication part 130 and the second communication part 140, which are placed on the upper and lower ends of the main body 110, with the main body 110. Stepped parts are formed on an inlet and outlet of the air introduction hole 110*b* and the air discharge hole 110*c*, respectively, and O-rings O are disposed in the inlet and outlet by which the first and second communication parts 130 and 140 can be more tightly coupled to the main body 110.

The motor assembly 120 is integrally coupled with a rear side of the main body 110, and a motor (not shown) and a rotation shaft 125 are mounted in the motor assembly 120 for transmitting a power to an external apparatus (not shown).

Figure 8:
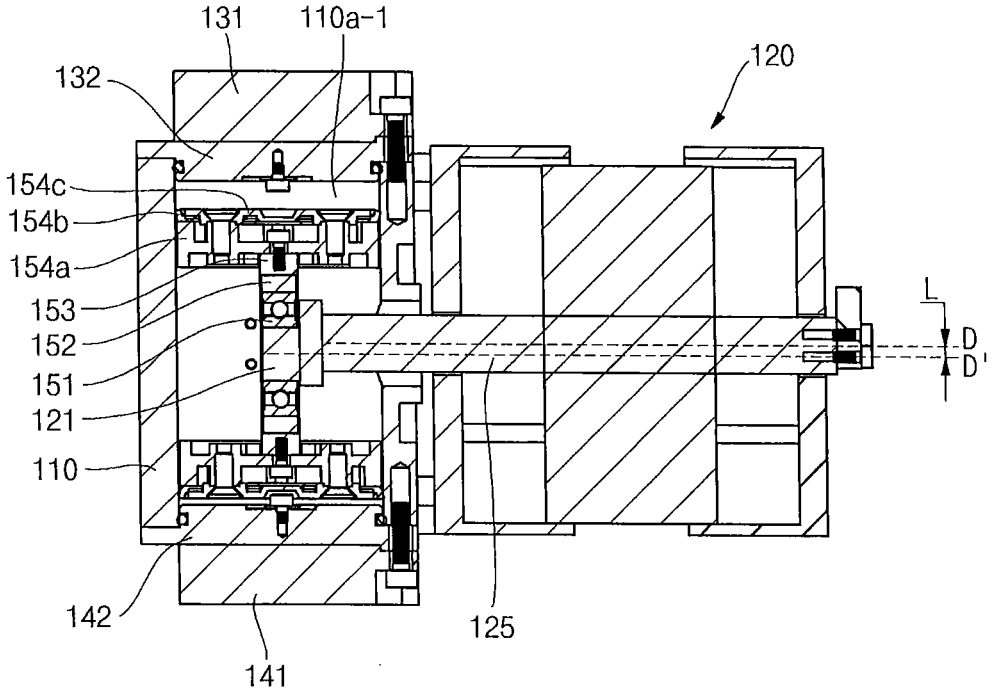
FIG. 8 is a cross-sectional view taken along the line VIII-VIII of FIG. 1.

In particular, the rotation shaft 125 passes through a side surface of the main body 110, and an eccentric shaft 121 which is eccentrically rotate in the cylinder 110*a* is provided at an end of the rotation shaft 125. Thus, as shown in FIG. 8, a center D' of the eccentric shaft 121 is spaced from a center D of the rotation shaft 125 by a distance L.

The first communication part 130 covers an upper portion 110*a*-1 of the cylinder 110*a* of the main body 110 to introduce and discharge air through the upper portion 110*a*-1 of the cylinder 110*a*.

Figure 3:
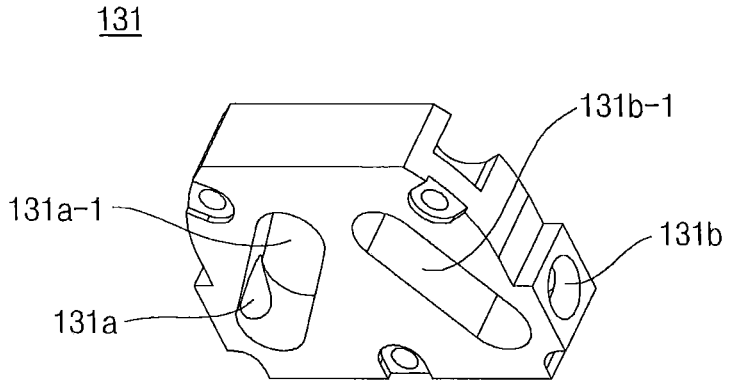
FIG. 3 is a lower perspective view of an upper cover shown in FIG. 2.
Figure 4:
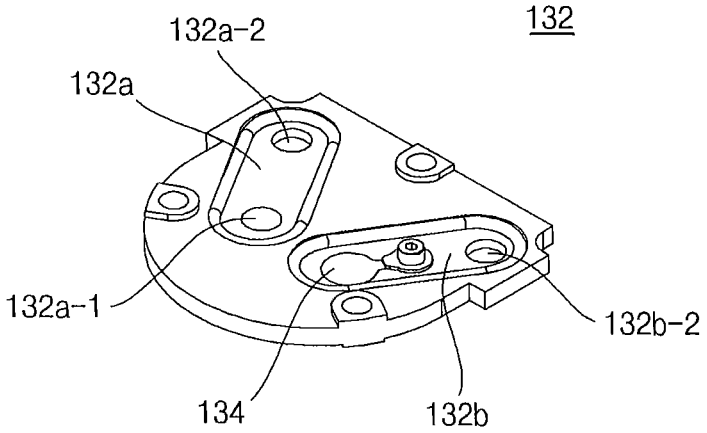
FIG. 4 is an enlarged perspective view of an upper check plate shown in FIG. 2.

To this end, as shown in FIG. 3 and FIG. 4, the first communication part 130 comprises an upper cover 131 covering the upper portion 110*a*-1 of the cylinder 110*a* and having an air introduction hole 131*a* and an air discharge hole 131*b* which are communicated with the cylinder 110*a* and formed at both sides thereof, and an upper check plate 132 disposed between the upper cover 131 and the upper end of the main body 110 and configured to be opened and closed by air pressure.

The upper cover 131 has an approximately tetragonal plate shape, and includes a first air receiving recess 131*a*-1 and a second air receiving recess 131*b*-1 formed on a lower surface thereof. The first air receiving recess 131*a*-1 has a slot shape and communicated with the air introduction hole 131*a*, and the second air receiving recess 131*b*-1 has a slot shape and communicated with the air discharge hole 131*b*. The first air receiving recess 131*a*-1 and the second air receiving recess 131*b*-1 correspond to each other.

Figure 5:
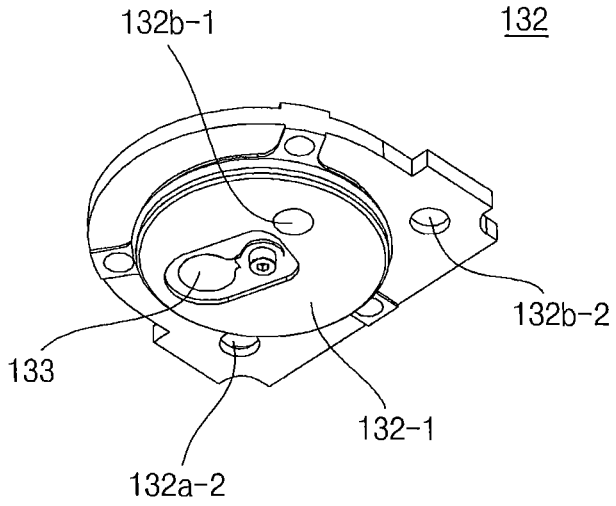
FIG. 5 is a lower perspective view of the check plate shown in FIG. 2.

Referring to FIGS. 4 and 5, the upper check plate 132 includes a first slot recess 132*a* formed on the upper surface thereof and corresponding to the first air receiving recess

131*a*-1, a first introduction hole 132*a*-1 passing through the first slot recess 132*a* for guiding air introduced through the air introduction hole 131*a* to the upper portion 110*a*-1 of the cylinder 110*a*, and a second introduction hole 132*a*-2 communicated with the air introduction hole 110*b* for guiding air introduced through the air introduction hole 131*a* to the lower portion 110*a*-2 of the cylinder 110*a*.

Further, it is preferable that the upper check plate 132 includes a second slot recess 132*b* formed on the upper surface thereof and corresponding to the second air receiving recess 131*b*-1, a first discharge hole 132*b*-1 passing through the second slot recess 132*b* for guiding air compressed in the upper portion 110*a*-1 of the cylinder 110*a* to the air discharge hole 131*b*, and a second discharge hole 132*b*-2 connecting the air discharge hole 110*c* to the air discharge hole 131*b* for guiding air compressed in the lower portion 110*a*-2 of the cylinder 110*a* to the air discharge hole 110*c*.

Here, gaskets G may be disposed between the first air receiving recess 131*a*-1 and the first slot recess 132*a* and between the second air receiving recess 131*b*-1 and the second slot recess 132*b*.

The upper check plate 132 may include a circular-shaped coupling part 132-1 protruded from a lower surface thereof. The coupling part 132-1 is coupled with the upper end of the main body 110. The O-ring O may be provided on an outer circumference surface of the coupling part 132-1 for enabling the coupling part 132-1 to be closely contacted with an inner surface of the upper end of the main body 110.

The first communication part 130 may further comprise a first check valve 133 provided under the upper check plate 132 to open and close the first introduction hole 132*a*-1 according to a predetermined air pressure or greater, and a second check valve 134 provided above the upper check plate 132 to open and close the first discharge hole 132*b*-1 according to compressed air.

To this end, a portion of the first check valve 133 is securely fixed to one surface of the upper check plate 132 through a washer W and a bolt, and the other portion of the first check valve opens and closes the first introduction hole 132*a*-1. And, a portion of the second check valve 134 is securely fixed to the other surface of the upper check plate 132 through the washer W and a bolt, and the other portion of the second check valve 134 opens and closes the first discharge hole 132*b*-1.

The second communication part 140 covers the lower portion 110*a*-2 of the cylinder 110*a* of the main body 110 to introduce/discharge air into/from the lower portion 110*a*-2 of the cylinder 110*a*.

To this end, as shown in FIG. 1, the second communication part 140 comprises a lower cover 141 covering the lower portion 110*a*-2 of the cylinder 110*a*, and a lower check plate 142 disposed between the lower cover 141 and the lower end of the main body 110 and configured to be opened and closed by air pressure. The lower cover 141 includes a first air receiving recess 141*a* and a second air receiving recess 141*b* formed on a surface thereof. The first air receiving recess 141*a* is communicated with the air introduction hole 110*b*, and the second air receiving recess 141*b* is communicated with the air discharge hole 110*c*.

Figure 6:
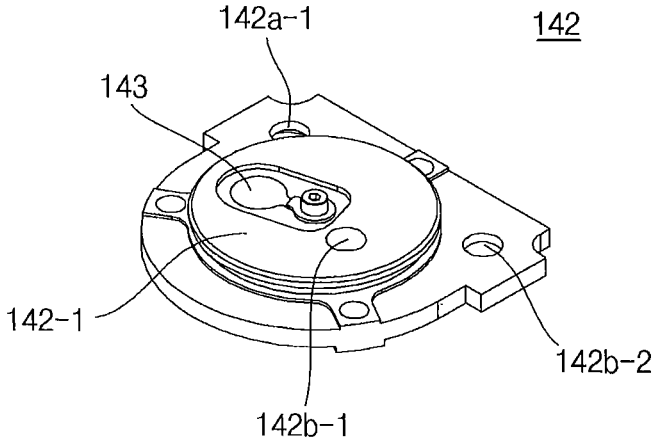
FIG. 6 is an enlarged perspective view of a lower check plate shown in FIG. 2.
Figure 7:
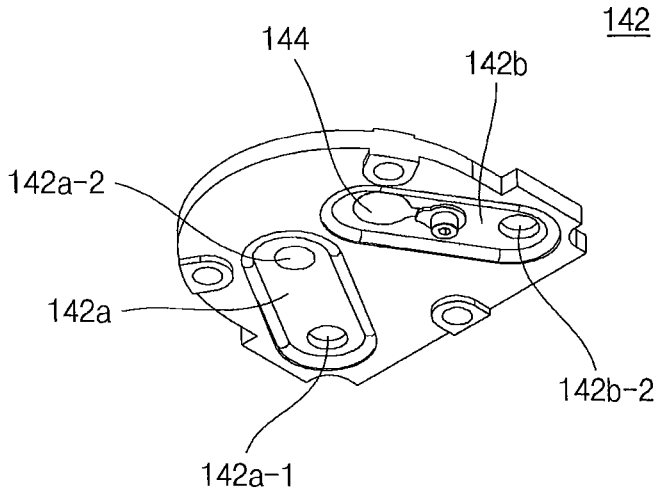
FIG. 7 is a lower perspective view of the lower check plate shown in FIG. 6.

As shown in FIG. 6 and FIG. 7, the lower check plate 142 includes a first slot recess 142*a* formed on a lower surface thereof and corresponding to the first air receiving recess 141*a*, a first introduction hole 142*a*-1 passing through the first slot recess 142*a* to communicate the air introduction hole 110*b* with the first air receiving recess 141*a*, and a second introduction hole 142*a*-2 passing through the first slot recess 142*a* for guiding air introduced through the first introduction hole 142*a*-1 to the lower portion 110*a*-2 of the cylinder 110*a*.

It is preferable that the lower check plate 142 may include a second slot recess 142*b* formed on the lower surface thereof and corresponding to the second air receiving recess 141*b*, a first discharge hole 142*b*-1 passing through the second slot recess 142*b* for guiding air compressed in the lower portion 110*a*-2 of the cylinder 110*a* to the second air receiving recess 141*b*, and a second discharge hole 142*b*-2 passing through the second slot recess 142*b* for allowing the second air receiving recess 141*b* to be communicated with the air discharge hole 110*c*.

Here, the gaskets G may be disposed between the first air receiving recess 141*a* and the first slot recess 142*a* and between the second air receiving recess 141*b* and the second slot recess 142*b*.

The lower check plate 142 may include a circular-shaped coupling part 142-1 protruded from the upper surface thereof. The coupling part 142-1 is coupled to the lower end of the main body 110. The O-ring O may be provided on an outer circumference surface of the coupling part 142-1 for enabling the coupling part 142-1 to be closely contacted with an inner surface of the lower end of the main body 110.

The second communication part 140 may further comprise a first check valve 143 provided above the lower check plate 142 to open and close the second introduction hole 142*a*-1 according to air bypassed to the air introduction hole 110*b*, and a second check valve 144 provided under the lower check plate 142 to open and close the first discharge hole 142*b*-1 according to compressed air.

To this end, a portion of the first check valve 143 is securely fixed to one surface of the lower check plate 142 through a washer W and a bolt, and the other portion of the first check valve 143 opens and closes the second introduction hole 142*a*-1. And, a portion of the second check valve 144 is securely fixed to the other surface of the lower check plate 142 through the washer W and a bolt, and the other portion of the second check valve 144 opens and closes the first discharge hole 142*b*-1.

The air compressing means 150 is connected to the eccentric shaft 121 of the motor assembly 120 and moved vertically in the cylinder 110*a* to compress alternately air introduced into the upper and lower portions 110*a*-1 and 110*a*-2 of the cylinder 110*a*.

The air compressing means 150 comprises: a bearing 151 provided to the outer circumference surface of the eccentric shaft 121; a bearing cover 152 fixed to the outer circumference surface of the bearing 151; a cross slider 153 including an ellipse part 153*a* having an inner circumference surface and corresponding to the outer circumference surface of the bearing cover 152, and guiding protrusions 153*b* formed on both sides on the outer circumference surface thereof; and upper and lower piston assemblies 154 linked respectively to the upper and lower portions of the cross slider 153 such that the upper and lower piston assemblies 154 are moved vertically in the upper and lower portions 110*a*-1 and 110*a*-2 of the cylinder 110*a*, respectively. Each guide protrusion 153*b* of the cross slider 153 corresponds to the vertical groove 111*a* of each guide 111

As such, the ellipse part 153*a* is formed on the inner circumference surface of the cross slider 153 and is in contact with the outer circumference of the bearing cover 152 to support an eccentric rotation of the eccentric shaft 121. Accordingly, the guiding protrusions 153*b* are supported by the guides 111, and so the cross slider 153 can be vertically slid.

At this time, the upper piston assembly includes a piston 154*a* coupled respectively to the upper portion of the cross slider 153 and moved vertically in the upper portion 110*a*-1 of the cylinder 110*a*, a cup 154*b* made from polytetrafluoroethylene (TEFLON®) provided on an end of the piston 154*a*, and a cup fixing cover 154*c* made from polytetrafluoroethylene (TEFLON®) fixed to the upper portion of the cup 154*b*. In addition, the lower piston assembly 154 includes a piston 154*a* coupled respectively to the lower portion of the cross slider 153 and moved vertically in the lower portion 110*a*-2 of the cylinder 110*a*, a cup 154 made from polytetrafluoroethylene (TEFLON®) provided on an end of the piston 154*a*, and a cup fixing cover 154*c* made from polytetrafluoroethylene (TEFLON®) fixed to the lower portion of the cup 154*b*.

Further, the hybrid type air-compressor 100 may comprise a rear balancer R.

Hereinafter, an operation of the hybrid type air-compressor 100 comprising the eccentric shaft and the cross slider mechanism according to the embodiment of the present invention will be described with reference to the accompanying drawings.

If the eccentric shaft 121 is eccentrically rotated by a rotation of the rotation shaft 125 as illustrated in FIG. 2, the cross slider 153 supported by the guides 111 of the main body 110 is slid downward by a contact force of the bearing cover 152.

Figure 9:
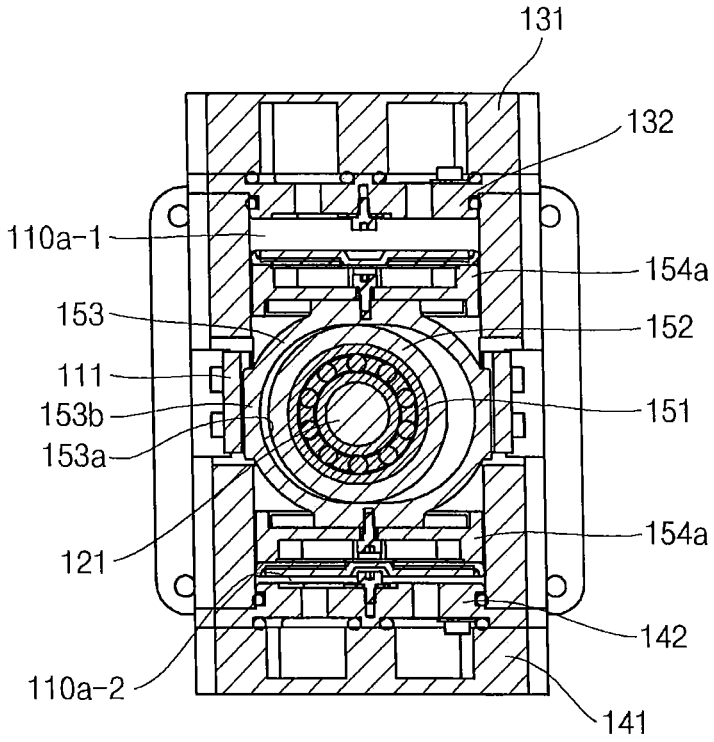
FIG. 9 is a cross-sectional view taken along the line IX-IX of FIG. 1.

Due to the above movement, the piston 154*a* of the upper piston assembly 154 is moved downward as illustrated in FIGS. 8 and 9, and external air is introduced into the air introduction hole 131*a* for the first time.

The air introduced into the air introduction hole 131*a* is introduced into the first air receiving recess 131*a*-1 of the upper cover 131. Since the first slot recess 132*a* with the first and second introduction holes 132*a*-1 and 132*a*-2 is formed on the upper surface of the upper check plate 132 corresponding to the upper cover 131, the introduced air overcomes the elasticity of the first check valve 133 and then entirely supplied to the upper portion 110*a*-1 of the cylinder 110*a*.

At this point, since air is compressed in the lower portion 110*a*-2 of the cylinder 110*a*, a pressure in the lower portion 110*a*-2 is relatively higher than that in the upper portion 110*a*-1, and so air is not introduced into the second introduction hole 132*a*-2.

Subsequently, if the eccentric shaft 121 is further rotated and becomes a state as shown in FIG. 2, the air introduced into the upper portion 110*a*-1 of the cylinder 110*a* is maximally compressed, and overcomes the elasticity of the second check valve 134. Finally, compressed air is discharged to an outside through the first discharge hole 132*b*-1 and the air discharge hole 131*b* of the upper cover 131.

While the air introduced into the upper portion 110*a*-1 of the cylinder 110*a* is compressed, new air is introduced into the lower portion 110*a*-2 of the cylinder 110*a* into through the air introduction hole 131*a*.

However, since the air is compressed in the upper portion 110*a*-1 of the cylinder 110*a*, a pressure in the upper portion 110*a*-1 is relatively higher than that in the lower portion 110*a*-2. Thus, the air is not introduced into the first introduction hole 132*a*-1.

That is, air introduced into the air introduction hole 131*a* is flowed into the first air receiving recess 131*a*-1, and then passes through the second introduction hole 132*a*-2 communicated with the first slot recess 132*a* and the air introduction hole 110*b* of the main body 110. Then, the air passes through the first introduction hole 142*a*-1 of the lower check plate 142 and the first air receiving recess 141*a* of the lower cover 141. Air overcomes the elasticity of the first check valve 143 and is then flowed into the lower portion 110*a*-2 of the cylinder 110*a* through the second introduction hole 142*a*-2.

Subsequently, when the eccentric shaft 121 is further rotated and becomes a state illustrated in FIG. 8 or 9, the air introduced into the lower portion 110*a*-2 of the cylinder 110*a* is maximally compressed, overcomes the elasticity of the second check valve 144 and is then flowed into the second air receiving recess 141*b* of the lower cover 141 and the second discharge hole 142*b*-2 of the lower check plate 142. Finally, air is discharged to an outside via the air discharge hole 110*c* of the main body 110 and the air discharge hole 131*b* of the upper cover 131.

The hybrid type air compressor according to the embodiment of the present invention as described above has the following advantages.

First, a conventional crank mechanism can be replaced with the air compressing means to decrease an installation space, thereby miniaturizing the air-compressor.

Secondly, the piston is not moved along the inclined path, but is vertically moved in the cylinder, and so a wear of the cup made from polytetrafluoroethylene (TEFLON®) can be significantly reduced to increase the service life thereof.

Thirdly, since two piston assemblies are provided on the single cross-slider, the structure of the air compressor is simpler than that of a conventional compressor, thereby reducing the number of parts.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present disclosure as set forth in the following claims.

What is claimed is:

1. A hybrid type air-compressor comprising:

a main body including a cylinder having opened upper and lower portions;

a motor assembly including an eccentric shaft passing through a side surface of the main body and rotated eccentrically in the cylinder;

a first communication part covering an upper portion of the cylinder of the main body for introducing air and discharging air to the upper portion of the cylinder;

a second communication part covering a lower portion of the cylinder of the main body for introducing air and discharging air to the lower portion of the cylinder;

an air compressing means connected to the eccentric shaft of the motor assembly and moved vertically in the cylinder to alternately compress air introduced into the upper and lower portions of the cylinder; and wherein the main body comprises an air introduction hole passing through the cylinder for bypassing and introducing some of air introduced into the first communication part into the lower portion of the cylinder; and comprises an air discharge hole passing through the cylinder for discharging air compressed in the lower portion of the cylinder.

2. The hybrid type air-compressor as claimed in claim 1, wherein the cylinder of the main body has a pair of guides provided fixedly thereon, the guides include vertical recesses corresponding to each other in the cylinder.

3. The hybrid type air-compressor as claimed in claim 1, wherein the first communication part comprises:

an upper cover covering the upper portion of the cylinder, and including an air introduction hole and an air discharge hole formed on both sides thereof and communicated with the cylinder; and an upper check plate provided between the upper cover and an upper end of the main body and configured to be opened and closed by air pressure.

4. The hybrid type air-compressor as claimed in claim 3, wherein the upper check plate comprises:

a first slot recess formed on an upper surface of the upper check plate;

a first introduction hole passing through the first slot recess for guiding some of air introduced through the air introduction hole to the upper portion of the cylinder; and a second introduction hole communicated with the air introduction hole for guiding air introduced through the air introduction hole to the lower portion of the cylinder.

5. The hybrid type air-compressor as claimed in claim 3, wherein the upper check plate comprises:

a second slot recess formed on an upper surface of the upper check plate;

a first discharge hole passing through the second slot recess for guiding air compressed in the upper portion of the cylinder to the air discharge hole; and a second discharge hole communicated with the air discharge hole is communicated with the air discharge hole for guiding air compressed in the lower portion of the cylinder to the air discharge hole.

6. The hybrid type air-compressor as claimed in claim 4, wherein the first communication part further comprises a first check valve provided under the upper check plate to open and close the first introduction hole according to a predetermined air pressure or greater.

7. The hybrid type air-compressor as claimed in claim 5, wherein the first communication part further comprises a second check valve provided above the upper check plate to open and close the first discharge hole according to compressed air.

8. The hybrid type air-compressor as claimed in claim 1, wherein the second communication part comprises:

a lower cover covering the lower portion of the cylinder, the lower cover including a first air receiving recess and a second air receiving recess formed on one side surface thereof, the first air receiving recess being communicated with the air introduction hole, the second air receiving recess being communicated with the air discharge hole; and a lower check plate provided between the lower cover and a lower end of the main body and configured to be opened and closed by air pressure.

9. The hybrid type air-compressor as claimed in claim 8, wherein the lower check plate comprises:

a first slot recess formed on a lower surface of the lower check plate and communicated with the first air receiving recess;

a first introduction hole passing through the first slot recess for allowing the air introduction hole to be communicated with the first air receiving recess; and a second introduction hole passing through the first slot recess for guiding air introduced through the first introduction hole to the lower portion of the cylinder.

10. The hybrid type air-compressor as claimed in claim 8, wherein the lower check plate comprises:

a second slot recess formed on a lower surface thereof and communicated with the second air receiving recess;

a first discharge hole passing through the second slot recess for guiding air compressed in the lower portion of the cylinder to the second air receiving recess; and a second discharge hole passing through the second slot recess for allowing the second air receiving recess to be communicated with the air discharge hole.

11. The hybrid type air-compressor as claimed in claim 9, wherein the second communication part further comprises a first check valve provided above the lower check plate to open and close the second introduction hole according to air bypassed to the air introduction hole.

12. The hybrid type air-compressor as claimed in claim 10, wherein the second communication part further comprises a second check valve provided under the lower check plate to open and close the first discharge hole according to compressed air.

13. The hybrid type air-compressor as claimed in claim 2, wherein the air compressing means comprises:

a bearing fixed to an outer circumference surface of the eccentric shaft;

a bearing cover fixed to an outer circumference surface of the bearing;

a cross slider including an ellipse part having an inner surface corresponding to the outer circumference surface of the bearing cover, and guiding protrusions formed on both sides on an outer surface thereof and corresponding respectively to the vertical grooves of the guides; and upper and lower piston assemblies linked to upper and lower portions of the cross slider, respectively, and being moved vertically in the upper and lower portions of the cylinder, respectively.

14. The hybrid type air-compressor as claimed in claim 13, wherein each of the upper and lower piston assemblies comprises:

a piston coupled to the upper or lower portion of the cross slider and moved vertically in the upper or lower portion of the cylinder;

a cup made from polytetrafluoroethylene and installed on an end of the piston, and a cup fixing cover fixed to upper or lower portion of the cup.

15. A hybrid type air-compressor comprising:

a main body including a cylinder having opened upper and lower portions;

a motor assembly including an eccentric shaft passing through a side surface of the main body and rotated eccentrically in the cylinder;

a first communication part covering an upper portion of the cylinder of the main body for introducing air and discharging air to the upper portion of the cylinder;

a second communication part covering a lower portion of the cylinder of the main body for introducing air and discharging air to the lower portion of the cylinder;

an air compressing means connected to the eccentric shaft of the motor assembly and moved vertically in the cylinder to alternately compress air introduced into the upper and lower portions of the cylinder; and wherein the cylinder of the main body has a pair of guides provided fixedly thereon, the guides include vertical recesses corresponding to each other in the cylinder.

16. The hybrid type air-compressor as claimed in claim 15, wherein the air compressing means comprises:

a bearing fixed to an outer circumference surface of the eccentric shaft;

a bearing cover fixed to an outer circumference surface of the bearing;

a cross slider including an ellipse part having an inner surface corresponding to the outer circumference surface of the bearing cover, and guiding protrusions formed on both sides on an outer surface thereof and corresponding respectively to the vertical grooves of the guides; and upper and lower piston assemblies linked to upper and lower portions of the cross slider, respectively, and being moved vertically in the upper and lower portions of the cylinder, respectively.

17. The hybrid type air-compressor as claimed in claim 16, wherein each of the upper and lower piston assemblies comprises:

a piston coupled to the upper or lower portion of the cross slider and moved vertically in the upper or lower portion of the cylinder;

a cup made from polytetrafluoroethylene and installed on an end of the piston, and a cup fixing cover fixed to upper or lower portion of the cup.

18. A hybrid type air-compressor comprising:

a main body including a cylinder having opened upper and lower portions;

a motor assembly including an eccentric shaft passing through a side surface of the main body and rotated eccentrically in the cylinder;

a first communication part covering an upper portion of the cylinder of the main body for introducing air and discharging air to the upper portion of the cylinder;

a second communication part covering a lower portion of the cylinder of the main body for introducing air and discharging air to the lower portion of the cylinder;

an air compressing means connected to the eccentric shaft of the motor assembly and moved vertically in the cylinder to alternately compress air introduced into the upper and lower portions of the cylinder;

wherein the main body comprises:

an air introduction hole vertically passing through a side portion of the cylinder for bypassing and introducing some of air introduced into the first communication part into the lower portion of the cylinder; and an air discharge hole vertically passing through an other side portion of the cylinder for discharging air compressed in the lower portion of the cylinder.

19. The hybrid type air-compressor as claimed in claim 18, wherein the first communication part comprises:

an upper cover covering the upper portion of the cylinder, and including an air introduction hole and an air discharge hole formed on both sides thereof and communicated with the cylinder; and an upper check plate provided between the upper cover and an upper end of the main body and configured to be opened and closed by air pressure.

20. The hybrid type air-compressor as claimed in claim 18, wherein the second communication part comprises:

a lower cover covering the lower portion of the cylinder, the lower cover including a first air receiving recess-and a second air receiving recess formed on one side surface thereof, the first air receiving recess being communicated with the air introduction hole, the second air receiving recess being communicated with the air discharge hole; and a lower check plate provided between the lower cover and a lower end of the main body and configured to be opened and closed by air pressure.

* * * * *